United States Patent [19]

Leupold

[11] Patent Number: 4,917,736

[45] Date of Patent: Apr. 17, 1990

[54] METHOD OF TRANSFORMING A PASSIVE FERROMAGNETIC MATERIAL INTO A PERMANENT MAGNET

[75] Inventor: Herbert A. Leupold, Eatontown, N.J.

[73] Assignee: The United States of America as represented by the Secretary of the Army, Washington, D.C.

[21] Appl. No.: 326,777

[22] Filed: Mar. 20, 1989

[51] Int. Cl.[4] ..... C21D 1/04

[52] U.S. Cl. ..... 148/108; 148/121; 505/700; 505/727

[58] Field of Search ..... 148/103, 108, 121, 122; 505/700, 727, 729

[56] References Cited

PUBLICATIONS

Dagani, "New Class of Superconductors Pushing Temperature Higher", C→EN, May 16, 1988, pp. 24 to 29.

*Primary Examiner*—John P. Sheehan

*Attorney, Agent, or Firm*—Michael Zelenka; Roy E. Gordon

[57] ABSTRACT

A passive ferromagnetic material is transformed into a permanent magnet with more than double the existing energy product or "strength" by encasing a bar of the passive ferromagnetic material in an annular shell of superconductive material at a temperature above the transition temperature of the superconductive material, placing the encased ferromagnetic material into an axial magnetic field providing sufficient oersteds to magnetize the passive ferromagnetic material thereby enclosing a large amount of flux in the superconducting shell, lowering the temperature to below the transition temperature of the superconductive material whereupon all of the enclosed flux is permanently trapped, and removing the axial magnetic field.

10 Claims, No Drawings

METHOD OF TRANSFORMING A PASSIVE FERROMAGNETIC MATERIAL INTO A PERMANENT MAGNET

The invention described herein may be manufactured, used and licensed by or for the Government for governmental purposes without the payment to me of any royalty thereon.

This invention relates in general to a method of treating a passive ferromagnetic material, and in particular to a method of transforming a passive ferromagnetic material into a permanent magnet with more than double the existing energy product or "strength" of the strongest presently available permanent magnets.

BACKGROUND OF THE INVENTION

A typical passive ferromagnetic material as for example, iron, has close to the highest saturation magnetization of any metal or alloy, as it is of the order of 21 kG. The very best permanent magnets now in use have remanences of less than 13 kG. These numbers translate to 42 MG-Oe and 110 MG-Oe energy product for the best permanent magnet and for iron respectively. Unfortunately, the very high energy product for iron is never realized since iron, like other passive ferromagnetic material, has a near zero coercivity or ability to keep its very high intrinsic magnetic moment when aligned in the face of even weak opposing magnetic fields.

SUMMARY OF THE INVENTION

The general object of this invention is to provide a method of treating passive ferromagnetic materials. A more particular object of the invention is to provide a method of transforming a passive ferromagnetic material into a permanent magnet with more than double the existing energy product or "strength". A still further object of the invention is to provide such a method of transformation without recourse to powerful electromagnets with their attendant inconveniences, power supplies, energy expenditure, heat production, etc. Another object of the invention is to provide a method of providing iron and other passive ferromagnetic materials with coercivities commensurate with their high saturation magnetizations so that they act as very high energy product permanent magnets. Another object of the invention is to provide a method of making permanent magnets that can be used as biasing structures in space electronics and navigational systems. A particular object of the invention is to provide a method of transforming iron into a 100 MGOe permanent magnet.

It has now been found that the aforementioned objects can be attained by a method including the steps of:

(A) encasing a bar of a passive ferromagnetic material in an annular shell of a superconductive material at a temperature above the transition temperature of the superconductive material, (B) placing the encased ferromagnetic material into an applied axial magnetic field providing sufficient oersteds to magnetize the passive ferromagnetic material, thereby enclosing a large amount of flux in the superconducting shell, (C) lowering the temperature to below the transition temperature of the superconductive material whereupon all of the enclosed flux is permanently trapped, and (D) removing the applied axial magnetic field.

Other passive ferromagnetic materials that can be used in the method include mixed-iron alloys containing from 40 to 80% nickel and having high magnetic permeability and electrical resistivity and an alloy of 58 parts iron, 40 parts cobalt and 2 parts vanadium.

As the superconductive shell material, one can use a high temperature superconductor such as the oxide $CuBa_2Y_3O_7$.

The transition temperature is the temperature above which the super conductive material is normal or non superconducting and below which the superconductive material is superconducting.

The magnetic field that is axial with respect to the iron encased superconducting shell can be applied by conventional means such as an electrical solenoid or permanent magnet at a strength typically less than 100 oersteds.

DESCRIPTION OF THE PREFERRED EMBODIMENT

An iron bar is encased in an annular shell of the oxide $CuBa_2Y_3O_7$ at a temperature of about 90° K. The assembly is placed in a small axial magnetic field of less than 100 oersteds provided by an electrical solenoid to magnetize the iron, thereby enclosing a large amount of flux in the superconducting shell. The temperature is then lowered to about 70° K. or below the transition temperature of the $CuBa_2Y_3O_7$ whereupon all of the enclosed flux is permanently trapped, and persistent current created in the superconducting shell maintains sufficient field to keep the iron magnetized and productive of 20 kG remanence. The small axial magnetic field is then removed and the iron is effectively a permanent magnet of 20 kG remanence with the superconducting shell providing the artificial coercivity that is limited only by the appropriate critical field of the superconductor. Ideally, $H_{cr}$ should be above 20 kOe but in the absence of so high a lower critical field, an upper critical field greater than 20 kOe will suffice providing flux pinning is sufficient to keep the enclosed flux trapped.

A permanent magnet could also be made without the iron bar or core but then, the applied field required to charge the shell with flux would be orders of magnitude higher and the critical field requirement for the superconductor much more stringent. The persistent current would also have to be much greater to sustain a flux density of 20 kG.

I wish it to be understood that I do not desire to be limited to the exact details of construction as described for obvious modifications will occur to a person skilled in the art.

What is claimed is:

1. Method of transforming a passive ferromagnetic material into a permanent magnet with more than double the existing energy product or, said method including the steps of:

(A) encasing a bar of the passive ferromagnetic material in an annular shell of superconductive material at a temperature above the transition temperature of the superconductive material, (B) placing the encased ferromagnetic material into an axial magnetic field providing sufficient oersteds to magnetize the passive ferromagnetic material, thereby enclosing a large amount of flux in the superconducting shell, (C) lowering the temperature to below the transition temperature of the superconductive material whereupon all of the enclosed flux is permanently trapped, and (D) removing the axial magnetic field.

2. Method according to claim 1 wherein the passive ferromagnetic material is selected from the group consisting of iron, nickel-iron alloys containing from 40 to 80% nickel and having high magnetic permeability and electrical resistivity and an alloy of 58 parts iron, 40 parts cobalt and 2 parts vanadium.

3. Method according to claim 2 wherein the passive ferromagnetic material is iron.

4. Method according to claim 2 wherein the passive ferromagnetic material is nickel-iron alloys containing from 40 to 80% nickel and having high magnetic permeability and electrical resistivity.

5. Method according to claim 2 wherein the passive ferromagnetic material is an alloy of 58 parts iron, 40 parts cobalt and 2 parts vanadium.

6. Method according to claim 3 wherein the superconductive material is $CuBa_2Y_3O_7$ and the temperature above the transition temperature is about 90° K.

7. Method according to claim 3 wherein the superconductive material is $CuBa_2Y_3O_7$and the temperature below the transition temperature is about 70° K.

8. Method according to claim 1 wherein the axial magnetic field is less than 100 oersteds and provided by an electrical solenoid.

9. Method according to claim 1 wherein the axial magnetic field is less than 100 oersteds and provided by a permanent magnet.

10. Method of transforming an iron bar into a permanent magnet with more than double the existing energy product said method including the steps of:

(A) encasing the iron bar in an annular shell of $CuBa_2Y_3O_7$ material at about 90° K., (B) placing the encased iron bar into an axial magnetic field of less than 100 oersteds provided by an electrical solenoid to magnetize the iron bar, thereby enclosing a large amount of flux in the $CuBa_2Y_3O_7$ shell, (C) lowering the temperature to about 70° K. whereupon all of the enclosed flux is permanently trapped, and (D) removing the axial magnetic field.

* * * * *